US006428226B1

(12) United States Patent
Suzuki et al.

(10) Patent No.: US 6,428,226 B1
(45) Date of Patent: Aug. 6, 2002

(54) PAPER DISCHARGE APPARATUS

(75) Inventors: Kanji Suzuki; Hideo Kanbe; Kazunori Ikegaya, all of Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 0 days.

(21) Appl. No.: 09/486,022

(22) PCT Filed: Aug. 11, 1998

(86) PCT No.: PCT/JP98/03564

§ 371 (c)(1),
(2), (4) Date: Feb. 18, 2000

(87) PCT Pub. No.: WO99/10181

PCT Pub. Date: Mar. 4, 1999

(30) Foreign Application Priority Data

Aug. 21, 1997 (JP) ..... 9-240398
Dec. 22, 1997 (JP) ..... 9-365513

(51) Int. Cl.[7] ..... B41J 13/10
(52) U.S. Cl. ..... 400/642; 400/619
(58) Field of Search ..... 400/642, 639.6, 400/621, 621.1, 621.2, 617, 611, 582, 625, 188; 271/228, 3.2, 3.24

(56) References Cited

U.S. PATENT DOCUMENTS 4,810,120 A * 3/1989 Narita et al. ..... 400/624
5,156,385 A * 10/1992 Muto et al. ..... 271/3
5,649,776 A * 7/1997 Sugimoto et al. ..... 400/617
5,887,867 A * 3/1999 Takanashi et al. ..... 271/117

FOREIGN PATENT DOCUMENTS

| | | |
|---|---|---|
| EP | 0 505 650 | 9/1992 |
| EP | 0 725 028 A1 | 1/1996 |
| GB | 2 033 250 | 5/1980 |
| JP | 07165362 A | 6/1995 |
| JP | 08169149 A | 7/1996 |
| JP | 08268638 A | 10/1996 |
| JP | 09263349 A | 10/1997 |
| JP | 10119375 A | 5/1998 |

* cited by examiner

*Primary Examiner*—Andrew H. Hirshfeld
*Assistant Examiner*—Darius N. Cone
(74) *Attorney, Agent, or Firm*—Scully, Scott, Murphy & Presser

(57) ABSTRACT

A paper discharge apparatus wherein a movable guide plate (23) is closed to guide a sheet of paper (P) when discharging paper (P), and is tilted downward to open a portion below a first conveyor passage (R1) when keeping or collecting paper (P) within the apparatus. The movable guide plate (23) is tilted downward to force paper fall for collection. This apparatus can stably issue and collect sheets of paper by reliably preventing jamming and stagnation of the sheets even when they have wrinkles and strong curls or when they are weakened.

9 Claims, 13 Drawing Sheets

PAPER DISCHARGE APPARATUS

TECHNICAL FIELD

The present invention relates to an improvement in paper discharge apparatuses for use in issuing apparatuses for issuing receipts, tickets, etc., using rolls of paper, for cutting and discharging printed slips, and for collecting discharged slips when they are not removed.

BACKGROUND ART

Automatic transaction machines such as cash dispensers, ATMs, information terminal apparatuses, etc., have been conventionally installed in unmanned shops, and these machines are provided with an issuing apparatus for issuing receipts or tickets on which necessary information is printed so as to report transaction information for a customer. As a method of printing in an issuing apparatus, thermal methods, dot impact methods, or the like are used. A roll of paper is unwound, necessary information is printed thereon, and a printed portion is cut by a paper cutting mechanism, whereby a receipt or a ticket is issued.

In a conventional issuing apparatus, paper is conveyed to a discharge port and is printed one line at a time, and the issuing paper is gradually discharged from the discharge port. Therefore, when a customer stands by while picking up the issuing paper, the paper is prevented from being conveyed, whereby it is warped in a loop-like state, and a paper jam is caused. When the customer picks up and pulls out the issuing slip of paper, the printing or cutting quality thereof is inferior, or a cutter blade in a cutting mechanism may be damaged, depending on the circumstances. In the case in which a customer leaves without receiving the issued slip of paper, there may be some problems such as the next issuance of a slip of paper is obstructed, or another customer may take the slip of paper whereby secret information thereon cannot be kept confidential.

Therefore, in order to solve the above problems, the present inventors developed a paper discharge apparatus which is disclosed in Japanese Unexamined Patent Application Publication No. 8(96)-268638. According to this paper discharge apparatus, a leading end of a issuing slip of paper is clamped by a pair of paper discharge rollers so as not to be discharged from the discharge port, and the paper is held in a loop-like state in an issuing apparatus until the printing and cutting operations are completed. In the paper discharge apparatus, the slip of paper is discharged from the discharge port after the printing and cutting operations are completed, and furthermore, the paper is retracted into the apparatus if a customer leaves it for a given period, whereby the above problems caused by an inadvertent action of the customer can be solved.

However, in the above paper discharge apparatus according to development by the present inventors, it is constructed such that a bottom portion of a paper conveyor passage which extends between a cutting mechanism and a pair of discharge rollers is opened so as to bend the slip of paper downward. The paper is thereby not at all restricted by the opened bottom portion in the paper conveyor passage. However, in order to reliably issue a slip of paper in a nearly unattended situation in which the apparatus is provided in an automatic transaction machine and to reliably collect a remaining slip of paper, there are the following problems even if the above paper discharge apparatus is employed.

That is, the automatic transaction machine may be installed in various places which may be outdoors or indoors, and it is also may be used under conditions of high temperature and high humidity, depending on the circumstances. In the case in which it is used under such adverse conditions, the paper may be weakened by absorbing moisture and curl in the shapes of the paper conveyor passage, guide rollers, etc. Alternatively, paper may be caused to have wavelike wrinkles at a leading end thereof and be bent so that both ends of a cut slip of paper hang down. In particular, when a thermal paper, on which a coating material is coated thereon, was originally a soft paper, such phenomena are apparent.

When paper weakens and the leading end thereof hangs down, the leading end does not reach a guide plate which is provided in front of a pair of discharge rollers. In this case, the paper is not discharged and drops into a collection tray which is provided in an issuing apparatus. When curls or wrinkles are caused in a paper, even if a leading end of the paper reaches a pair of discharge rollers, the paper cannot be clamped between the pair of discharge rollers, thereby causing a paper jam. When the winding diameter of a roll of paper is very small, the paper strongly curls, whereby the paper cannot be clamped between the pair of discharge rollers.

When a remaining paper is collected, there may be the following problems. For example, in a printing device, an electrical charge is stored on a surface of a paper as a static electrical charge. In particular, this phenomenon is apparent under low humidity conditions. In this case, the collected paper adheres to a plastic guide plate or other portions by static electrical charge, whereby the paper blocks a paper collecting passage and cannot be collected. When the winding diameter of a roll of paper is very small, the paper strongly curls, whereby the paper causes a blockage and obstructs the paper collecting passage.

Furthermore, when a pair of discharge rollers is provided on both surfaces of a paper, as shown in FIG. 14, the center of the paper in the cross direction bends, whereby it becomes more rigid along the longitudial direction. In such a case, when a leading end of the paper contacts an inner wall of an issuing apparatus, an excessive load is caused at a pair of discharge rollers, whereby a motor is continuously rotated while operating a torque limiter, so that a control error is caused.

A customer often inserts a card or a coin into a paper discharge port by mistake. In this case, there is a problem in that a paper discharge passage and a discharge port may be obstructed, preventing a receipt, etc., from being issued. Furthermore, it is desirable that the apparatus be improved so that the taking of a receipt, etc., will be forgotten as rarely as possible.

Therefore, the present invention was made in view of the above-described circumstances, and it is an object thereof to provide a paper discharge apparatus which can securely prevent paper jams and paper retention from occurring so that paper issuing and collecting operations can be reliably performed, and moreover, which can prevent some problems from occurring even if a user performs various operations incorrectly.

DISCLOSURE OF INVENTION

In a first aspect of the present invention, a paper discharge apparatus comprises: a paper printing device for printing on a paper; a paper conveyor device for conveying the paper to the paper printing device; a paper cutting device disposed downstream of the paper printing device for cutting the paper when a printing operation is completed; a pair of discharge rollers disposed downstream of the paper cutting device for conveying the paper toward a paper discharge port, the pair of discharge rollers clamping a leading end of the paper until the printing operation is completed so as to bend the paper downward to form a loop between the paper cutting device and the pair of discharge rollers, conveying the paper downstream until a trailing end of the paper leaves off the paper cutting device, and conveying the paper upstream to collect the paper which is discharged at the paper discharge port and not removed; and a paper sensing device provided near the paper discharge port. Furthermore, the present invention is characterized by comprising a paper guide device is provided along both surfaces of the paper between the paper cutting device and the pair of discharge rollers, having a movable guide member which is adapted to open the bottom of a paper conveyor passage extending from the paper cutting device to the pair of discharge rollers at least when the paper is bent downward to form a loop.

According to the paper discharge apparatus as constructed above, the movable guide member opens the bottom of the paper conveyor passage, whereby the paper can be bent downward by clamping a leading end of the paper between the pair of discharge rollers until the printing and cutting operations are completed. Therefore, an inadvertent action of a customer can be prevented, and moreover, a collected slip of paper can be dropped at a given place. In particular, according to the present invention, since the bottom of the paper conveyor passage which extends from the cut device to the pair of discharge rollers can be closed when the paper is conveyed to the pair of discharge rollers, the paper can be securely clamped between the pair of discharge rollers by guiding the paper using a guide device even if the paper curls strongly, wrinkles, or weakens.

Here, the movable guide member is inclinably supported at an upstream end thereof so as to move between a first position in which the guide member extends along the paper and a second position in which the guide member inclines downward, and a downstream free end of the guide device can be inclined so as to release the paper to be collected. The collected paper thereby does not obstruct the paper collecting passage due to static electrical charge or curling, so that the paper collecting operation can be securely performed.

As another device for smoothly collecting the paper, a paper receiving member extending downward from the upstream end thereof when the movable guide member is located at the first position, which bends by contacting a trailing end of the paper to be collected, and which thrusts downward the trailing end of the paper, can be provided. According to such a construction, when the trailing end of the paper bent upward at the center thereof in the cross direction contacts the paper receiving member, the paper receiving member bends backward to escape, whereby the trailing end of the paper is turned downward and becomes softer. Consequently, an excessive load given to the pair of discharge rollers can be effectively prevented from occurring. It is preferable that the paper receiving members be provided at two points on both surfaces of the paper in the cross direction. In such a construction, the end of the paper is firstly bent at a corner which is easily bent.

Furthermore, it is preferable that a paper thrusting member be provided at a downstream free end of the movable guide member, in which the paper thrusting member protrudes upward from the free end to the downstream of the movable guide member, reaches a side surface of an upper discharge roller of the pair of discharge rollers when the movable guide member is located at the first position, and the paper is passed so that it bends downward when the paper is discharged. In this construction, since the paper thrusting member is located at a side surface of the discharge roller, it does not interfered with the discharge roller. Therefore, the paper thrusting member does not prevent the discharge roller from rotating when the paper is collected, and moreover, the paper thrusting member extends in the vicinity of a clamping portion of the pair of discharge rollers, whereby the paper is restrained until the pair of discharge rollers clamps it; the paper can then be securely clamped between the pair of discharge rollers even if a leading end of the paper curls to a great extent. In addition, according to this construction, there is also an advantage in that the collected paper is not inserted into a paper conveyor passage above the movable guide member even if a trailing end (upstream end) of the collected paper curls strongly upward.

A shutter is provided on the movable guide member by way of a connecting device, and is constructed for opening and closing the discharge port in association with the inclination of the movable guide member, whereby a foreign material such as a card, a coin, etc., can be effectively prevented from being inserted into the discharge port.

In a second aspect of the present invention, a paper guide device is provided downstream of the pair of discharge rollers along both surfaces of the paper, instead of the above paper guide device, and the paper guide device is constructed so that a paper feeding angle at a conveying portion of the pair of discharge rollers is different from that at a discharging portion facing the discharge port. Such a construction can be also provided in the above-described first aspect of the present invention.

According to such a paper discharge apparatus, since paper feeding angles in the paper guide device are different, even if a foreign material such as a card, etc., is inserted into the discharge port, it is blocked by the paper guide device and is thereby not inserted further therein. Therefore, the recipient can see that an operation is incorrect and pull out the card, etc., thereby performing the operation correctly.

In a third aspect of the present invention, a pair of second discharge rollers facing the discharge port is provided downstream of a pair of first discharge rollers, instead of the guide device of the second paper discharge device. This pair of second discharge rollers clamps a trailing end of the paper until the paper discharged from the discharge port is removed and conveyed the paper upstream toward the pair of first discharge rollers when the paper remains for a given period, thereby collecting the paper. Such a construction can be also provided in the above-described first or second aspect of the present invention.

According to such a paper discharge apparatus, most of the paper can be exposed even if the length of the paper is short, whereby attention of the user can be drawn to the paper and the paper P can prevented from being forgotten. In this case, the pair of second discharge rollers is rotated so as to convey the paper upstream to a position at which the paper sensing device can detect the paper when a given period elapses after the paper is discharged at the discharge port. The paper can thereby be collected when the paper sensing device detects the paper.

Furthermore, the pair of second discharge rollers is rotated to convey the paper upstream to a position at which the paper sensing device can detect the paper after the paper is discharged at the discharge port. The paper can thereby be also collected when the paper is continuously detected for a given period by the paper sensing device. In this case, since it can be always determined by the paper sensing device whether or not the paper is present, the next operation can be started without waiting for a given period after receiving the paper.

In a fourth aspect of the present invention, common tangents of the pair of first discharge rollers and the pair of second discharge rollers in the above-described third aspect are inclined with respect to each other. According to such a construction, even if a foreign material such as a card, etc., is inserted into the discharge port, it is blocked by the pair of first discharge rollers or other members so that it is not inserted further therein, and so that the user can see that the operation is incorrect.

BEST MODE FOR CARRYING OUT THE INVENTION

A paper discharge apparatus according to the present invention will now be described with reference to the figures, illustrating embodiments employed in a printer.

1. First Embodiment

A. Construction of Printer

Figure 1:
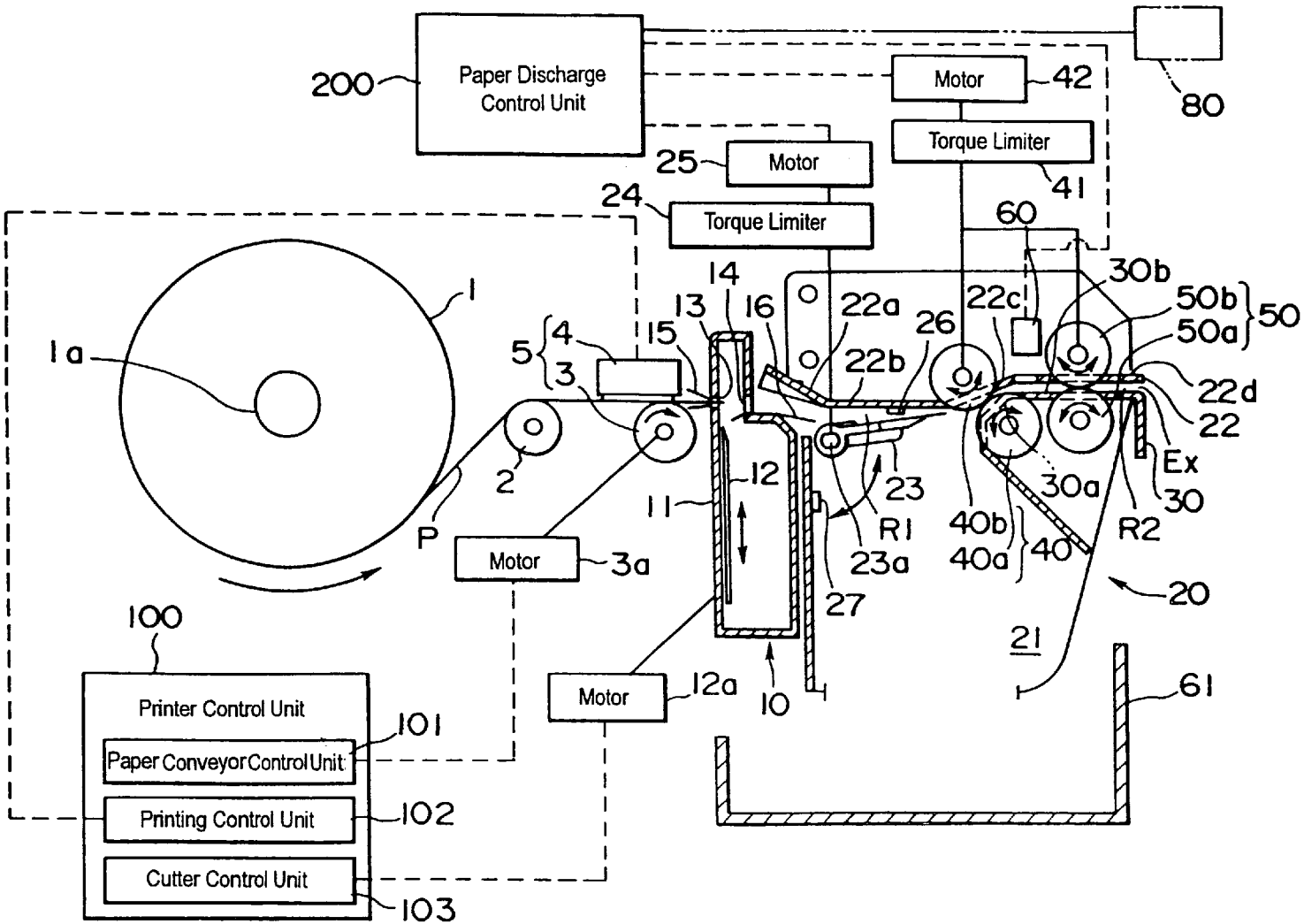
FIG. 1 is a sectional side view of a printer employed a paper discharge apparatus according to a first embodiment of the present invention.

FIG. 1 is a sectional side view showing the overall construction of a printer according to a first embodiment of the invention. Since this printer conveys a paper P from the left to the right in the figure, in the following explanation, the left in the figure refers to the upstream (trailing end) and the right refers to the downstream (leading end). Reference numeral 1 in the figures refers to a roll of paper wound around a winding shaft 1*a*. The winding shaft 1*a* is rotatably supported in a printer. An idle roller 2 is rotatably supported downstream of the roll of paper 1. A printing mechanism (printing device) 5 is mounted further downstream and is provided with a platen roller 3 which can be rotated by a motor 3*a* and a thermal printing head 4 disposed opposing above this platen roller 3. The thermal printing head 4 prints line by line on a paper P unwound from the roll paper 1 while moving in a direction crossing at a right angle to the paper surface in the figures. The thermal printing head 4 is thrust on the platen roller 3, whereby the paper P can be conveyed by frictional force generated between the paper P and the platen roller 3.

A cutter (cutting device) 10 is mounted downstream of the printing mechanism 5. Reference numeral 11 refers to a housing of the cutter 10, and a cutter blade 12 is provided in the housing 11 so that it can be moved in the vertical direction by a motor 12*a*. Slits 13 and 14 for passing the paper P are formed on the housing 11, and guides 15 and 16 for guiding the paper P are attached to each slit 13 and 14. A paper conveyor portion 20 for discharging and collecting the paper P is mounted downstream of the cutter 10.

A frame 21 is provided on both sides of the paper conveyor portion 20 (both sides in a direction crossing at a right angle to the paper surface in the figures). A first fixed guide plate (guide device) 22 is attached to the frame 21 so as to extend almost horizontally over the entire length of the frame 21. A first inclined plate portion 22*a* is provided on a trailing end of the first fixed guide plate 22 so as to incline with a rising gradient toward the upstream, whereby a leading end of the paper P is inserted below the first fixed guide plate 22 even if the end is curled upward. A first horizontal plate portion 22*b* is provided downstream of the first inclined plate portion 22*a* so as to extend almost horizontally. A second inclined plate portion 22*c* is provided downstream of the first horizontal plate portion 22*b* so as to incline with a rising gradient toward the downstream, and a second horizontal plate portion 22*d* is provided downstream of the second inclined plate portion 22*c* so as to extend almost horizontally. A movable guide plate (movable guide member) 23 is attached below the first horizontal plate portion 22*b*.

A trailing end of the movable guide plate 23 is rotatably secured to a shaft 23*a* supported on the frame 21. A rotating shaft of a motor 25 is connected to the shaft 23*a* by way of a torque limiter 24, whereby the movable guide plate 23 can incline in the direction denoted by an arrow around the shaft 23*a* in the figures. A first conveyor passage R1 for guiding and passing the paper P is formed by the guide 16, the movable guide plate 23, the first inclined plate portion 22*a* and the first horizontal plate portion 22*b* of the first fixed guide plate 22. Reference numerals 26 and 27 in the figures refer to switches which are turned on when the movable guide plate 23 comes to a risen end position or a fallen end position, respectively.

A second fixed guide plate 30 is attached below the second inclined plate portion 22*c* and the second horizontal plate portion 22*d* of the first fixed guide plate 22. A leading end of the second fixed guide plate 30 is bent downward, whereby a discharge port Ex is formed between the end and a leading end of the second horizontal plate portion 22*d*. A trailing end of the second fixed guide plate 30 is turned about 120 degrees downward. A second conveyor passage R2 for guiding and passing the paper P is formed by a bend portion 30*a*, a horizontal plate portion 30*b* which extends toward the downstream, the second inclined plate portion 22*c*, and the second horizontal plate portion 22*d* of the first fixed guide plate 22. A trailing end portion of the second conveyor passage R2 inclines with a rising gradient and a leading end portion thereof extends almost horizontally, whereby feeding angles of the paper P in the portions are different from each other.

A driven roller 40*a* and a driving roller 40*b,* which constitute a pair of first discharge rollers 40, protrude from the bend portion 30*a* of the second fixed guide plate 30 and the second inclined plate portion 22*c* of the first fixed guide plate 22, respectively. The driven roller 40*a* is rotatably supported on the frame 21. The driving roller 40*b* is thrust on the driven roller 40*a* by a suitable force, and the shaft of the roller 40*b* is connected to a rotating shaft of a motor 42 by way of a torque limiter 41. The pair of first discharge rollers 40 can be rotated for discharging the paper P and can be rotated in reverse for collecting the paper. A common tangent of the pair of first discharge rollers 40 inclines with a rising gradient toward the downstream.

A driven roller 50*a* and a driving roller 50*b,* which constitute a pair of second discharge rollers 50, protrude from the horizontal plate portion 30*b* of the second fixed guide plate 30 and the second horizontal plate portion 22*d* of the first fixed guide plate 22, respectively. The driven roller 50*a* is rotatably supported on the frame 21. The driving roller 50*b* is thrust on the driven roller 50*a* by suitable force, and the shaft of the roller 50*b* is connected to a rotating shaft of the motor 42 by way of a torque limiter 41, in the same way as the pair of first discharge rollers 40. The pair of second discharge rollers 50 can be rotated in the same direction as the pair of first discharge rollers 40. A common tangent of the pair of second discharge rollers 50 extends generally horizontally.

Reference numeral 60 in the figures refers to a sensor for detecting the paper, and reference numeral 61 refers to a collection tray.

B. Construction of Control Apparatus

The construction of the control apparatus for controlling an operation of a printer will now be described. The control apparatus comprises, for example, a microcomputer which includes a memory such as EPROM, RAM, etc.; a CPU; and an I/O unit and is provided with the printer control unit 100 for controlling operations from printing to cutting and the paper discharge control unit 200 for controlling discharging and collecting operations of a cut paper. A paper conveyor control unit 101 is provided in the printer control unit 100, in which the paper conveyor control unit 101 controls conveying the paper P. Reference numeral 102 refers to a printing control unit for controlling an operation in which the thermal printing head 4 prints on the paper P. Print data are input from an external host computer, etc., to the printing control unit 102, by way of a CPU. Reference numeral 103 refers to a cutter control unit for controlling the rotation of the motor 12*a* so as to move the cutter blade 12 in the vertical direction. The paper discharge control unit 200 controls the rotation of the motor 25 so as to incline the movable guide plate 23 at a given timing and controls the motor 42 for rotating the pairs of first and second discharge rollers 40 and 50.

C. Printer Operations

Paper Discharge

Figure 4:
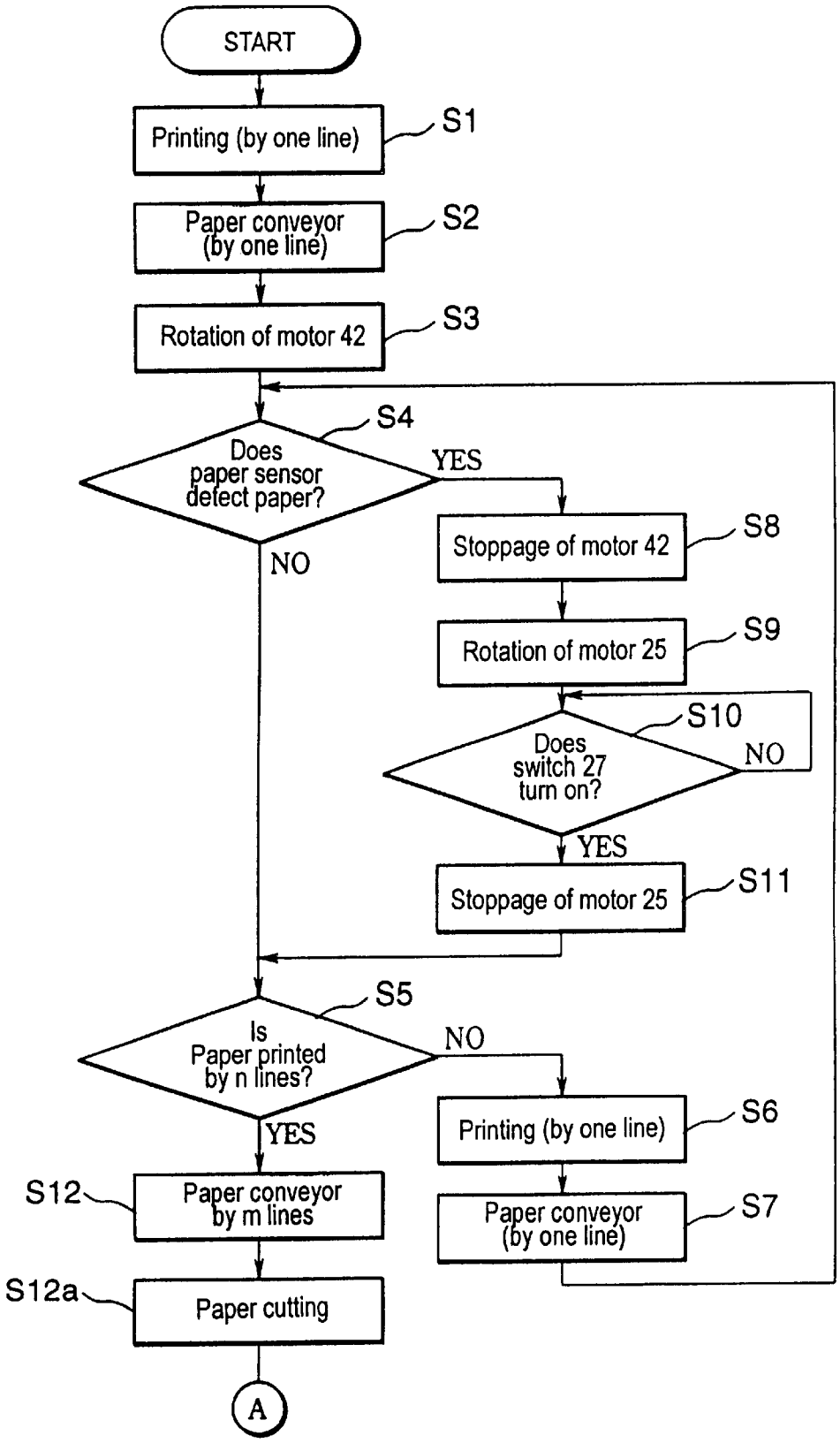
FIG. 4 is a flow chart showing from a paper printing operation to a paper cutting operation.

The operations from printing on the paper P to cutting are executed according to algorithm shown in FIG. 4. The apparatus is initialized by turning on a power switch, thereby being set in a state shown in FIG. 1. Print data and a print starting signal are input to a CPU by pushing a print button, etc., provided on a front panel, etc., of a printer, and the printing control unit 102 prints on the paper P by one line according to an instruction of the CPU (step S1). A program goes to step S2 where the paper P is conveyed by one line. The paper conveyor control unit 101 controls the motor 3*a,* thereby rotating the platen roller 3, so that the paper conveyor operation is performed. The program goes to step S3 where the rotation (normal rotation) of the pairs of first and second discharge rollers 40 and 50 are started by rotating the motor 42. The program goes to step S4 where it is determined whether or not a sensor 60 detects the paper P. If the sensor 60 does not detect the paper P, the determination in step S4 is "No", whereby the program goes to step S5 where it is determined whether or not the printing by predetermined lines (n lines) is completed. A counter of the CPU additionally counts the number of printed lines in step S1 or step S6 at every completion of one line and this number is subtracted from values (n) which is written into a register of the CPU, when the result is zero, it is determined that the predetermined lines are completed. If the printing by the n lines is not completed, the determination in step S5 is "No", whereby the program goes to step S6 where the paper P is printed by one line and then the program goes to step S7 where the paper P is conveyed by one line. Unless the printing by the n lines is completed, the procedures in steps S4 through S7 are repeated.

When the printing of some lines is performed, the paper P is conveyed toward the downstream so as to guide along the first conveyor passage R1, and the leading end thereof reaches the pair of discharge rollers 40 and is clamped therebetween. In the case in which the platen roller 3 is rotated and conveys the paper P, the paper P is conveyed toward the downstream by the pair of first discharge rollers 40. However, in the case in which the platen roller 3 is stopped and the next printing operation starts, the paper P is kept between the platen roller 3 and the thermal print head 4, whereby the torque limiter 41 is activated and the rotation of the pair of first discharge rollers 40 is stopped. When the printing operation is completed, the paper P is conveyed further toward the downstream by rotating of the platen roller 3 and the pair of first discharge rollers 40. If the leading end of the paper P is detected by the sensor 60, the determination in step S4 is "Yes", and the program goes to step S8 where the rotation of the motor 42 is stopped.

The program goes to step S9 where the motor 25 is rotated (normal rotation), whereby the movable guide plate 23 is inclined downward. The program goes to step S10 where it is determined whether or not the switch 27 is turned on by the movable guide plate 23. If the determination in step S10 is "No", the procedure in step S10 is repeated. If the switch 27 is turned on, the determination in step S10 is "Yes", whereby the program goes to step S11 where the rotation of the motor 25 is stopped.

Figure 2:
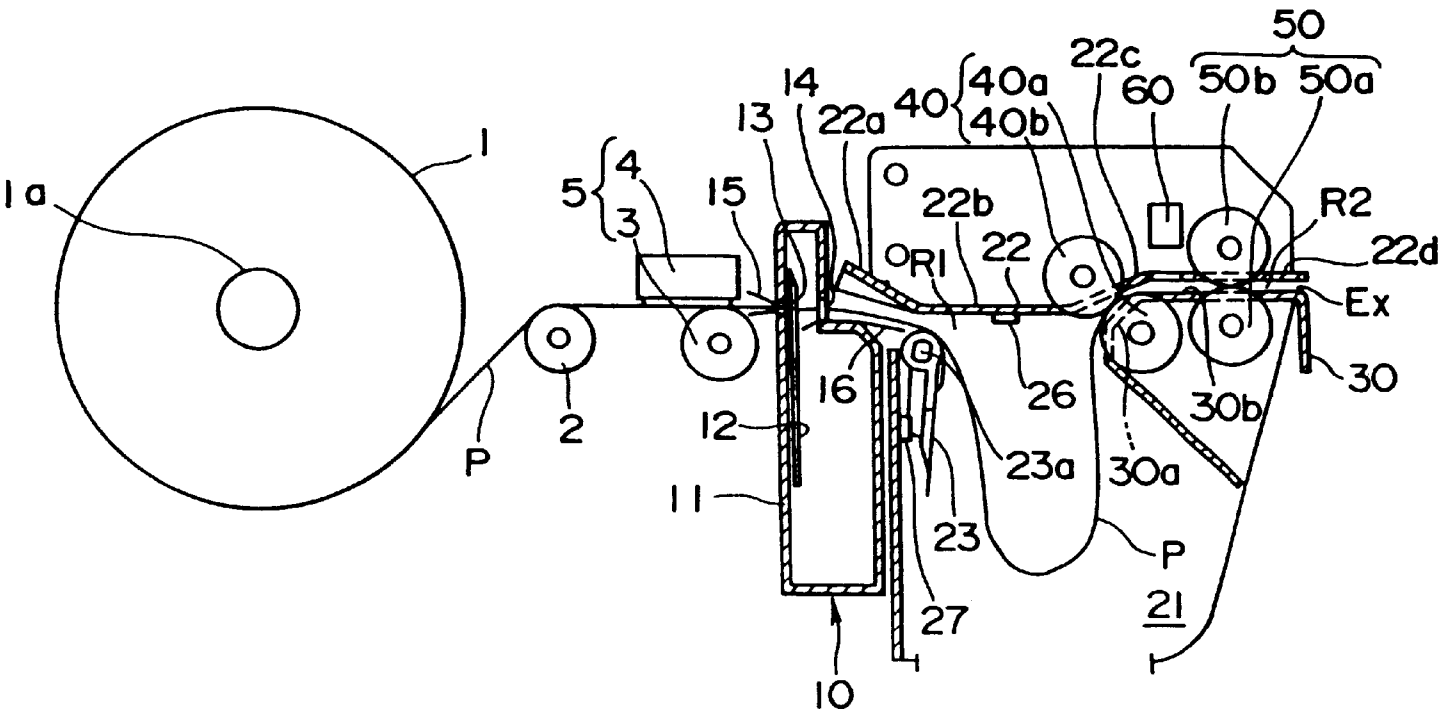
FIG. 2 is a sectional side view of a printer showing a paper bending state in a paper discharge apparatus.

When the printing by the n lines is completed, the determination in step S5 is "Yes", whereby the program goes to step S12 where the platen roller 3 is rotated and the paper P is conveyed by the m lines. Then, the program goes to step S12*a* where the cutter blade 12 is raised and falls, whereby the paper P is cut off. FIG. 2 shows this state. As shown in FIG. 2, a bottom of the first conveyor passage R1 is opened, and the paper P bends downward and forms a loop at this portion.

Figure 5:
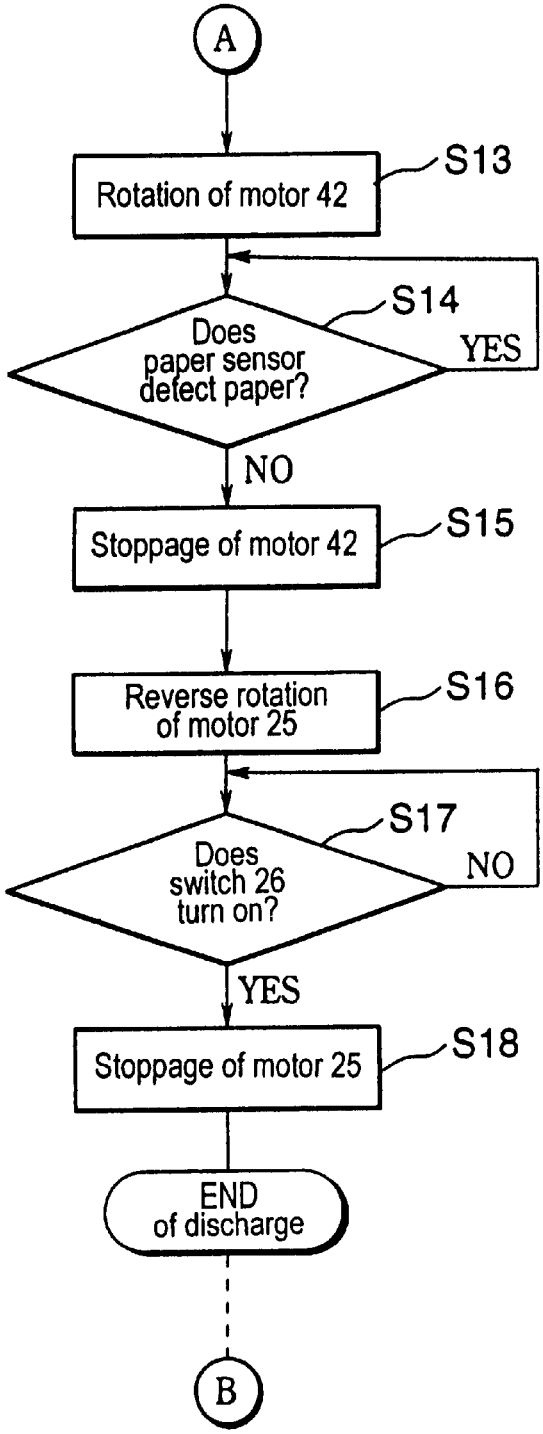
FIG. 5 is a flow chart showing a paper discharging operation after a cutting operation.

The discharge of the paper P is performed according to an algorithm shown continuously in FIGS. 4 through 5. The pairs of first and second discharge rollers 40 and 50 are rotated by the motor 42, whereby the paper P is conveyed downstream (step S13), so that it is determined whether or not the sensor 60 detects the paper P (step S14). The procedure in step S14 is repeated while the sensor 60 detects the paper P. If the sensor 60 does not detect the paper P, the program goes to step S15 where the rotation of the motor 42 is stopped. This state is such that the paper P passes the sensor 60 and the trailing end thereof is clamped by the pair of second discharge rollers 50 whereby most of the paper P is exposed from the discharge port Ex.

Thereafter, the program goes to step S16 where the motor 25 is rotated in reverse, whereby the movable guide plate 23 is inclined upward. The program goes to step S17 where it is determined whether or not the switch 26 is turned on by the movable guide plate 23. If it is turned off, the procedure in step S17 is repeated. If the switch 26 is turned on, the determination in step S17 is "Yes", whereby the program goes to step S18 where the rotation of the motor 25 is stopped. Consequently, the discharging operation of the paper P is completed.

When the paper P is discharged from the discharge port Ex, there is a risk that a recipient will prevent the paper from being discharged by picking it up. In this case, if the rotation of the pairs of first and second discharge rollers 40 and 50 is continued, the paper forms a wavy loop inside the printer, whereby a normal discharging operation cannot be performed, so that a paper jam is caused. In this embodiment, if the paper P is prevented from being discharged, the motor 42 is run in idle by activating the torque limiter 41, whereby paper feed is stopped. When external force on the paper P is eliminated, the torque limiter 41 is deactivated, whereby the pairs of first and second conveyor rollers 40 and 50 are rotated and discharge of the paper P is resumed.

When the torque limiter 41 is activated so that the recipient pulls the paper P out from the discharge port Ex, the pair of first and second discharge rollers 40 and 50 can be easily rotated. Therefore, the recipient can easily pull out the paper P. Since the pair of second discharge rollers 50 which is closed to the discharge port Ex clamps the trailing end of the paper P, most of the paper P is exposed from the discharge port Ex. The attention of the recipient is thereby directed to the paper P, and the paper P is prevented from being forgotten. Since the movable guide plate 23 is raised and closes downward when the paper P passes through the first conveyor passage R1, the paper P can be inserted almost straight between the pair of first conveyor rollers 40 even if the paper P wrinkles, curls strongly, or weakens, thereby preventing a jam of the paper P from occurring.

Figure 6:
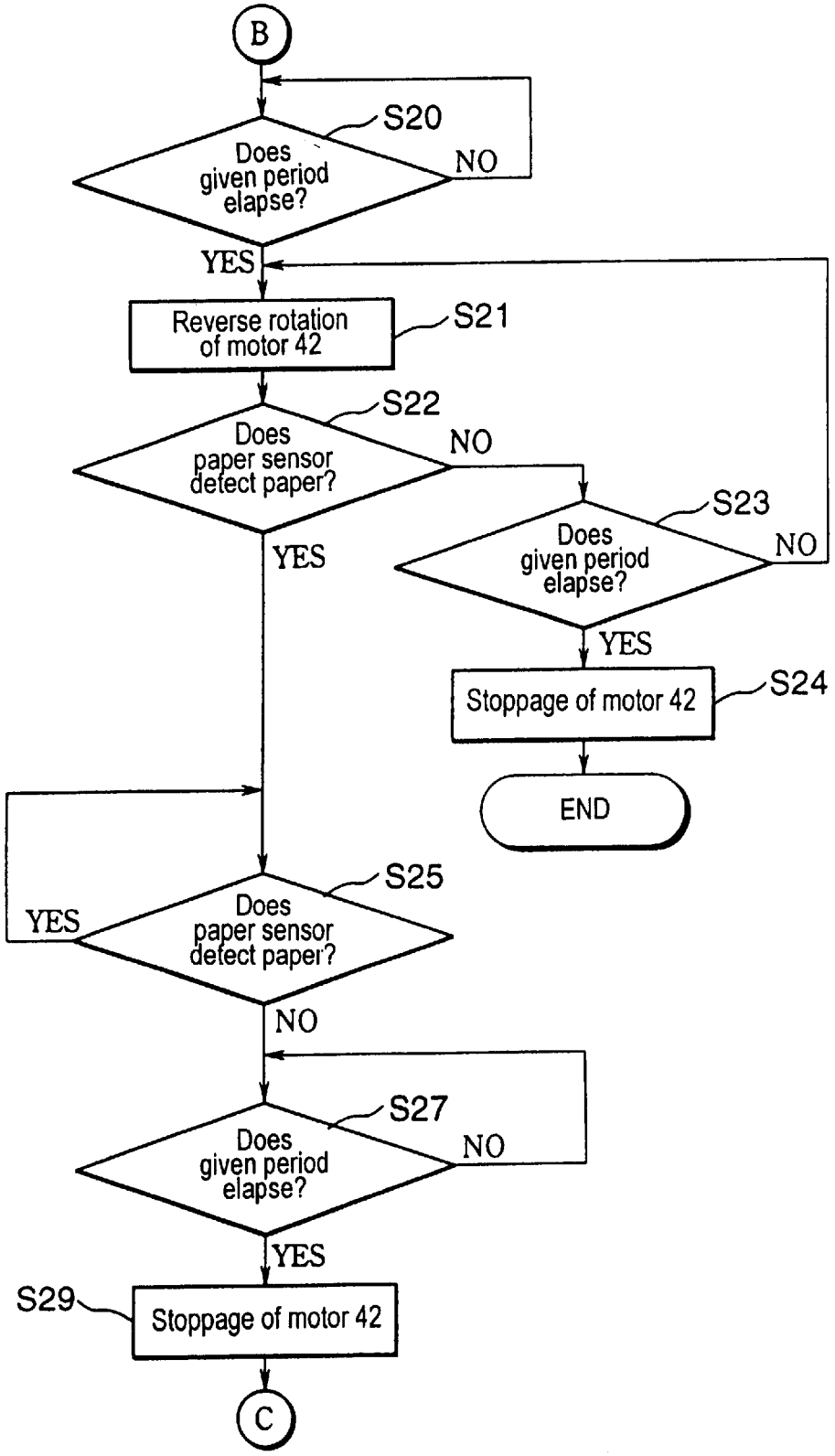
FIG. 6 is a flow chart showing a paper collecting operation.
Figure 7:
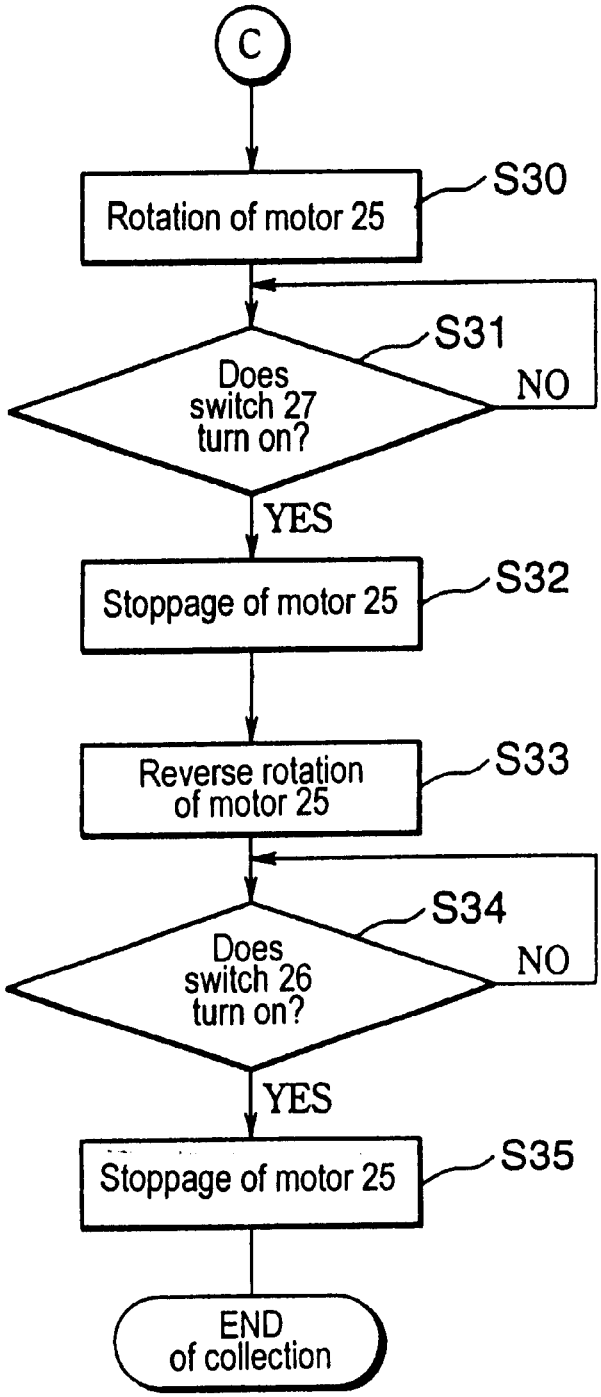
FIG. 7 is a flow chart showing an operation where a paper is released in a paper discharge apparatus while collecting the paper.

Thereafter, the operation for collecting the paper P is described with reference to FIGS. 6 and 7. As shown in FIG. 6, when a given period elapses after the motor 42 is stopped, the program goes from step S20 to step S21 where the motor 42 is rotated in reverse. The program goes to step S22 where it is determined whether or not the sensor 60 detects the paper P. If the paper P is not detected, the program goes to step S23 where it is determined whether or not a given period elapses after the reverse rotation of the motor 42 is started. If the sensor 60 does not detect the paper P and the given period does not further elapse, the program repeats the procedures in steps S21 through S23. If the given period elapses in step S23, the program goes to step S24 where the motor 42 is stopped. Consequently, the operation in the case in which the paper P was normally received is completed.

When the sensor 60 detects the paper P, the determination in step S22 is "Yes", whereby the program goes to step S25 where it is determined again whether or not the sensor 60 detects the paper P. If the paper P is detected, the motor 42 is rotated in reverse and the procedure in step S25 is repeated until the sensor 60 does not detect it. If the determination in step S25 is "No", the program goes to step S27 where the motor 42 is rotated in reverse further for a given period after the paper P is not detected in step S25 and the procedure in step S27 is repeated until the given period elapses. When the reverse rotation of the motor 42 is continued for a given period after the paper P is not detected, the determination in step S27 is "Yes", whereby the program goes to step S29 where the reverse rotation of the motor 42 is stopped.

When the above-described operation is completed, the end of the paper P leaves the pair of first discharge rollers 40 and the paper P falls and is stored in the collection tray 61. However, the paper P may adhere to the pair of first discharge rollers 40 or another portion due to static electrical charge, or the paper P may curl strongly upward whereby a blockage may be caused in the paper collecting passage. Therefore, in this embodiment, the operation for releasing the paper P is performed according to the algorithm shown continuously in FIGS. 6 through 7.

Figure 3:
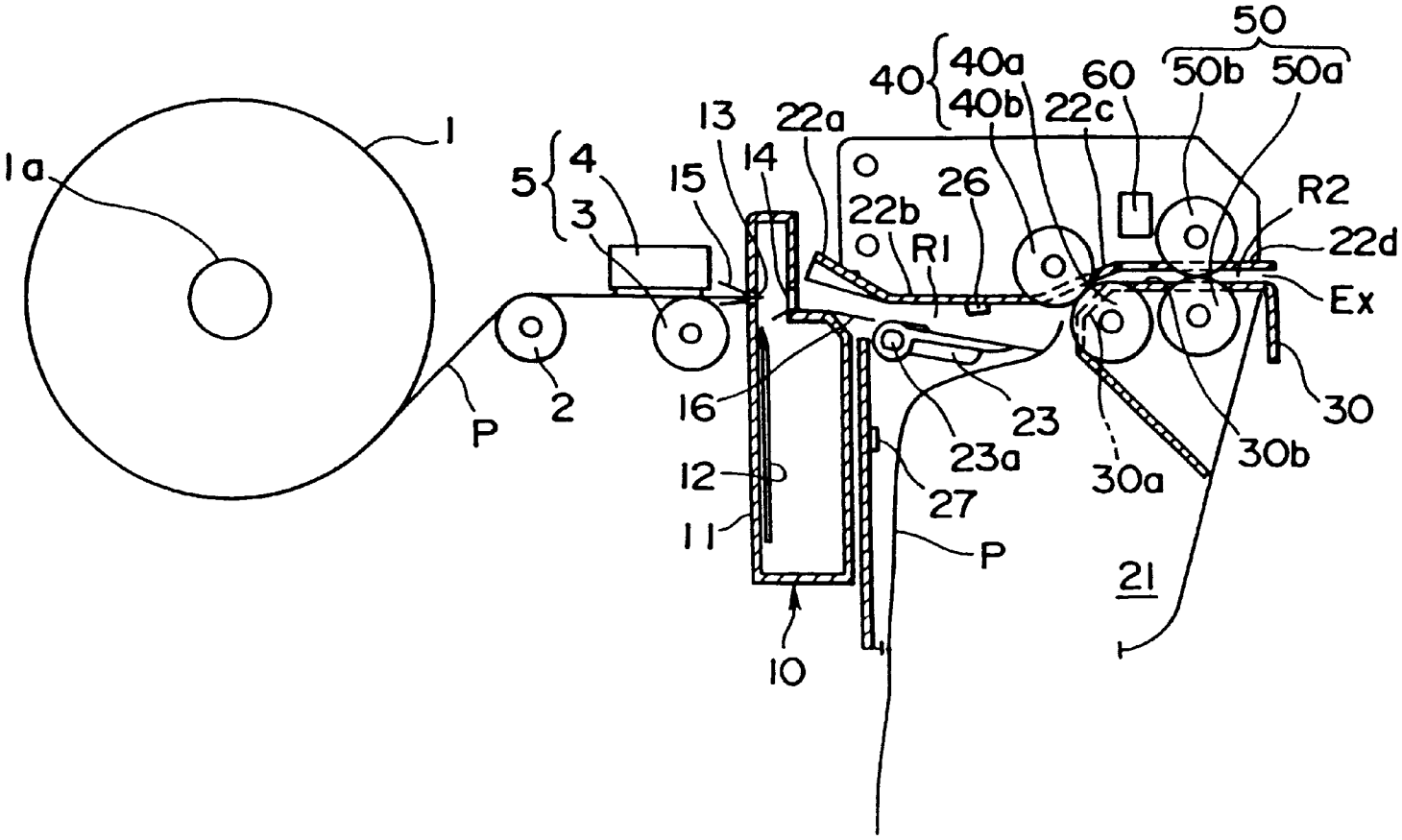
FIG. 3 is a sectional side view of a printer showing a state where a paper is released in a paper discharge apparatus while the paper is collected.

The movable guide plate 23 is inclined downward by rotating the motor 25 (step S30). As shown in FIG. 3, the paper P is thereby released by the movable guide plate 23. The motor 25 is rotated until the switch 27 is turned on by the movable guide plate 23 (step S31). When the switch 27 is turned on, the motor 25 is stopped (step S32). Thereafter, the motor 25 is rotated in reverse (step S33), and the motor 25 is stopped (steps S34 and S35) when the switch 26 is turned on.

According to the above paper discharge apparatus, in addition to the above-described effects, an effect is obtained which prevents foreign materials from being inserted into the discharge port Ex. That is, as is apparent in FIG. 1, if a card, etc., is inserted into the discharge port Ex, it is blocked by the second inclined plate portion 22*c* of the first fixed guide plate 22 and is thereby not inserted further therein. Therefore, when the recipient notices the incorrect operation, the card, etc., can be pulled out and correct operation can be performed. Since common tangents of the pairs of first and second discharge rollers 40 and 50 incline with respect to each other, the insertion of the card, etc., is also blocked by the pair of first discharge rollers.

2. Second Embodiment

The second embodiment according to the present invention will now be described with reference to FIG. 8. A shutter 70 is provided in an embodiment shown in FIG. 8 so as to open and shut the discharge port Ex. A pair of arms (connecting members) 71 is secured to both edges of a base portion of the movable guide plate 23, an end of the arm is protruded from a front panel of the printer, and the shutter 70 is secured thereto. In this case, when the sensor 60 detects the paper P, the motor 25 can be controlled so as to incline the movable guide plate 23 downward. Such a construction may effectively prevent foreign materials from being inserted into the discharge port Ex.

Figure 8:
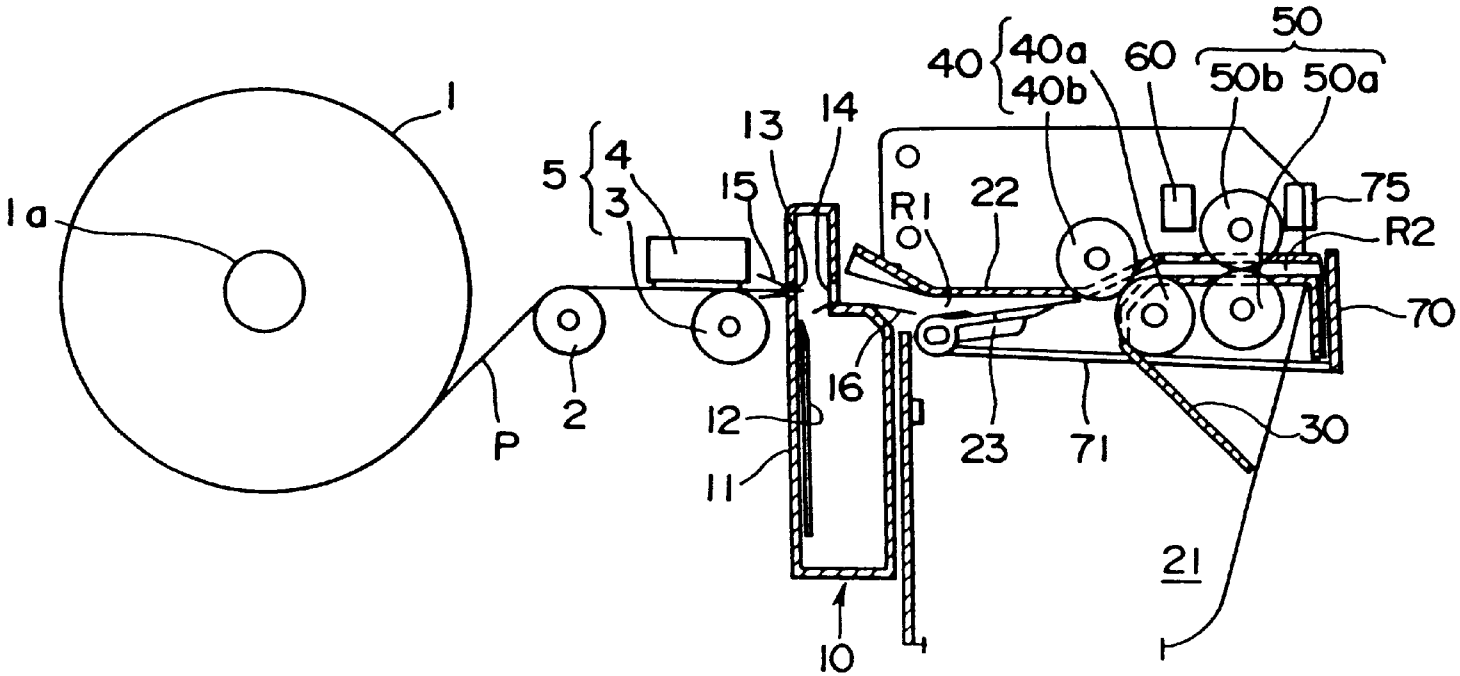
FIG. 8 is a sectional side view of a printer provided with a shutter, etc., according to a second embodiment of the present invention.

As shown in FIG. 8, a sensor 75 for detecting the paper P may be further a provided downstream of the pair of second discharge rollers 50. It can be immediately determined whether or not the paper P is received by providing this sensor 75, eliminating the need for the operation in which the pair of second discharge rollers 50 is reversely rotated until the sensor 60 detects the paper P (steps S20 through S24 in FIG. 6), whereby consumption of electricity, rollers, etc., can be decreased.

As shown by the two-dot chain line in FIG. 1, a sensor 80 for detecting people may be provided, for example, at a suitable portion on a front panel. As the sensor 80, for example, an infrared sensor can be employed. Even if a recipient is at a loss how to operate the printer and does not receive the paper P for a while, the paper P is not collected since the sensor 80 detects the recipient.

3. Third Embodiment

Figure 9:
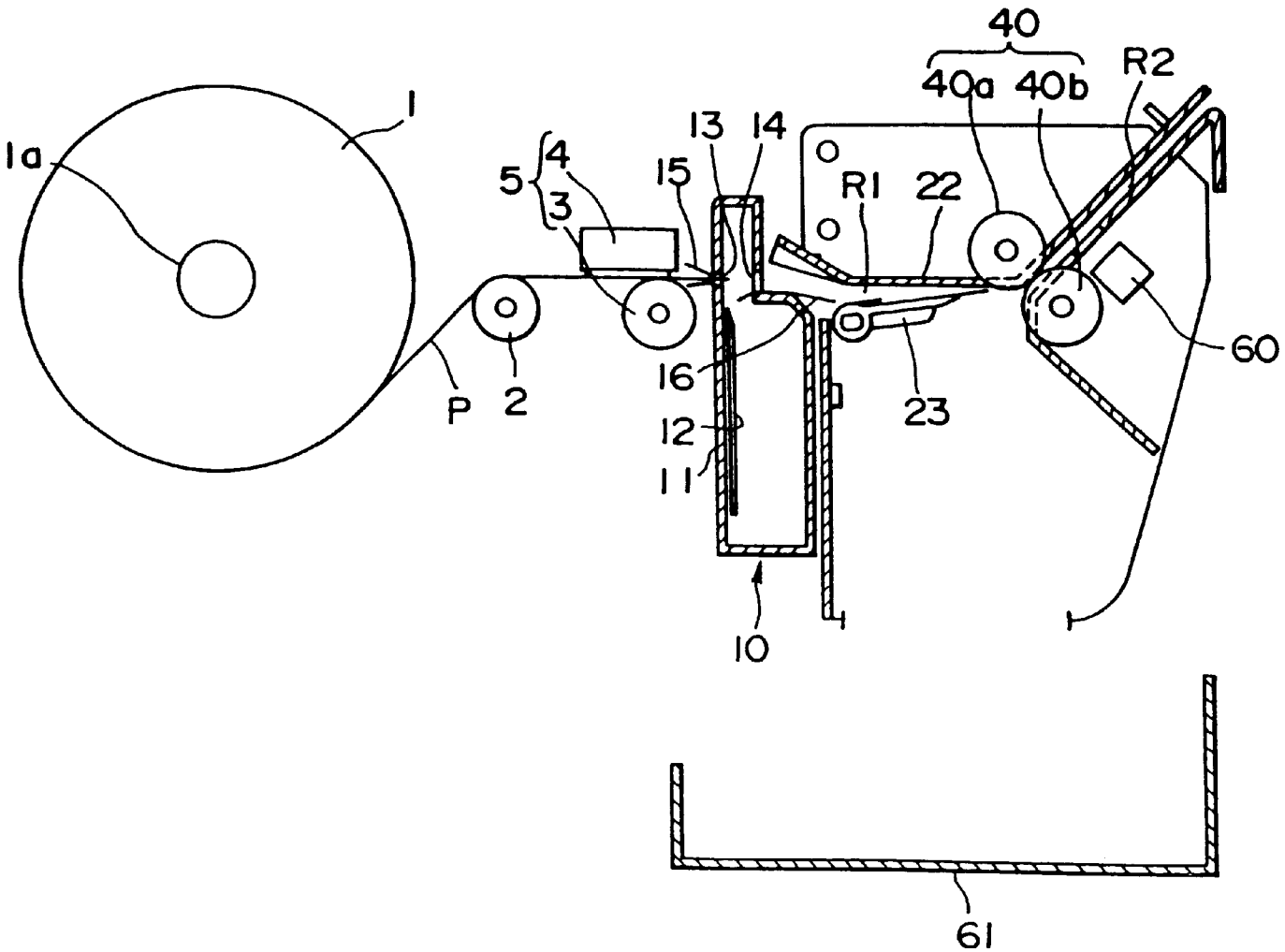
FIG. 9 is a sectional side view of a printer according to a third embodiment of the present invention, in which a second paper conveyor passage R2 is linearly provided.

The embodiment shown in FIG. 9 according to the present invention is one in which the pair of second discharge rollers is omitted from components of the above embodiments, and in which a second conveyor passage R2 is provided so as to extend almost linearly along a common tangent of the pair of first discharge rollers 40. The movable guide plate 23 is provided in this embodiment, thereby reliably performing discharging and collecting operations even if a paper wrinkles, curls strongly, or weakens.

4. Fourth Embodiment

Figure 10:
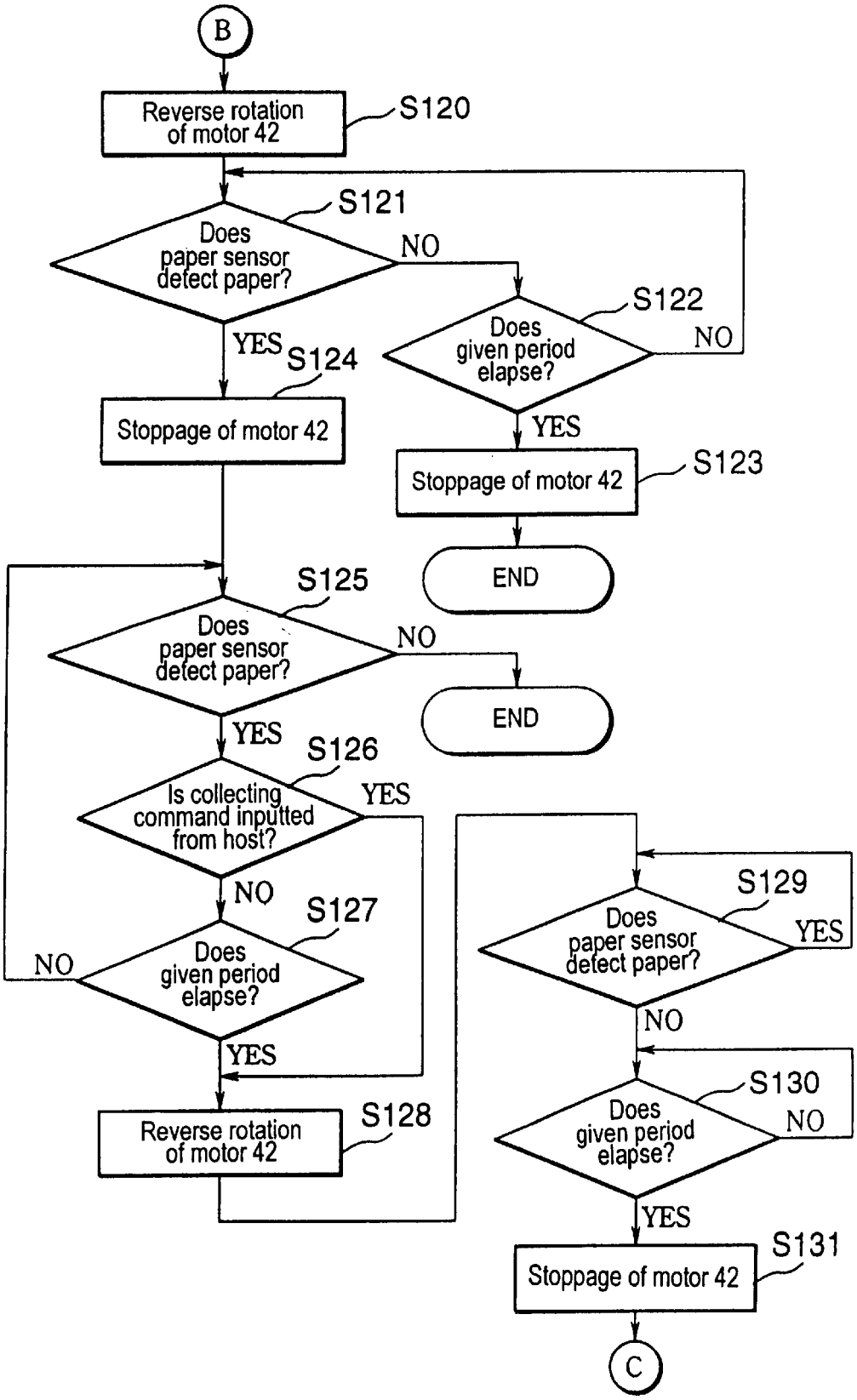
FIG. 10 is a flow chart showing a paper collecting operation according to a fourth embodiment of the present invention.

The fourth embodiment shown in FIG. 10 is one in which the paper collecting control in FIG. 6 is altered, and in which the sensor 60 always detects the paper P which is discharged to the discharge port Ex and is returned by only a short length thereof, thereby always determining whether or not the paper P is present. The paper collecting control of this embodiment will be now described from a state in which the operation for discharging the paper P is completed in step S18 in FIG. 5. When the operation for discharging is completed, the reverse rotation of the motor 42 is started in step S120 in FIG. 10. Thereafter, the program goes to step S121 where it is determined whether or not the sensor 60 detects the paper P. If the paper P is not detected, the program goes to step S122 where it is determined whether or not a given period has elapsed after starting the reverse rotation of the motor 42. If the sensor 60 does not detect the paper P and the given period does not further elapse, the procedures in steps S121 and S122 are repeated. If the given period elapses in step S122, the program goes to step S123 where the motor 42 is stopped. Consequently, the operation in the case in which the paper P was normally received is completed.

When the sensor 60 detects the paper P, the determination in step S121 is "Yes", the program goes to step S124 where the motor 42 is stopped, thereafter the program goes to step S125 where it is determined whether or not the sensor 60 detects the paper P. If the sensor 60 does not detect the paper P, the procedure of the paper collecting control is completed. That is, the operation in the case in which the paper P was received is completed. When the sensor 60 detects the paper P, the program goes to step S126 where it is determined whether or not a collecting command is inputted from an external host computer. The host computer outputs the collecting command according to detecting signals inputted from, for example, an infrared sensor for detecting a user as described above.

When the collecting command is inputted from the host computer in step S126, the program jumps to step S128 where the below-described collecting operation of the paper P is started. When the collecting command is not inputted, the program goes to step S127 where it is determined whether or not a given period has elapsed after stopping the motor 42 in step S124. If the given period does not elapse, the procedures in steps S125 through S127 are repeated.

When the given period elapses in step S127, the program goes to step S128 where the reverse rotation of the motor 42 is started, and thereafter the collecting operation after step S129 is performed. Since the control after step S129 is the same as steps S25 through S29 in FIG. 6, an explanation thereof is omitted.

According to the above embodiment, it can always be determined whether or not the paper P is presented at the discharge port Ex, whereby the next operation can be started without waiting for a given period after receiving the paper P, and the collection of the paper P can be also controlled by a command from a host computer. In the case in which the infrared sensor continuously detects users lined up in front of the apparatus, in which the infrared sensor has a problem, or the like, the paper P is collected after a given period elapses even if the collecting command is not inputted from a host computer.

5. Fifth Embodiment

Figure 11:
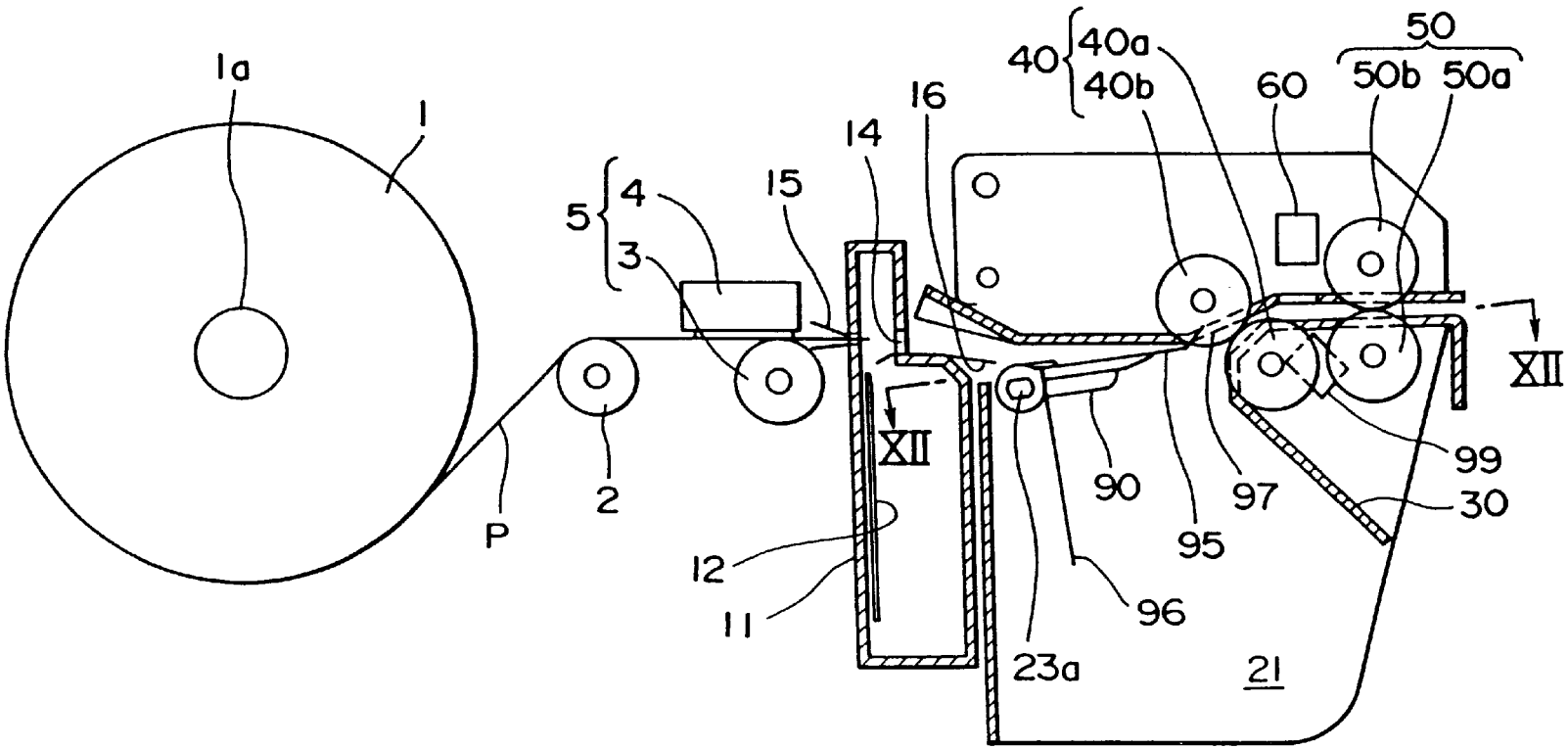
FIG. 11 is a sectional side view of a printer employing a paper discharge apparatus according to a fifth embodiment of the present invention.
Figure 12:
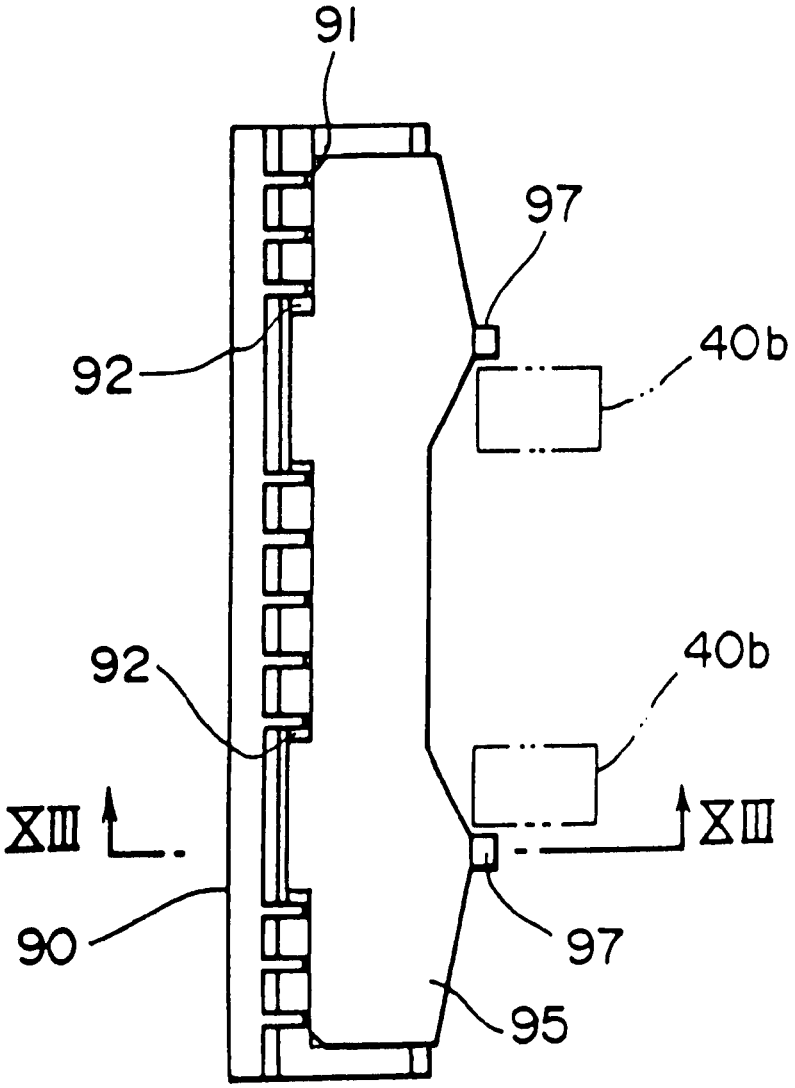
FIG. 12 is a plane view showing a cross-section taken along line XII—XII of a movable guide plate and a thrusting plate in FIG. 11.
Figure 13:
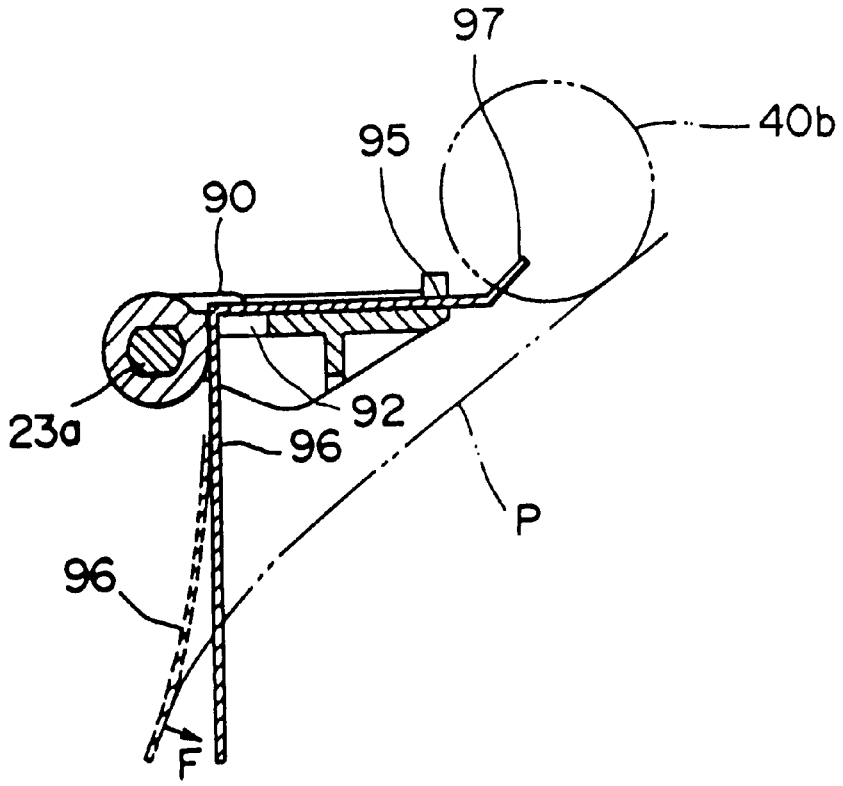
FIG. 13 is a partial side view of the paper discharging apparatus according to the fifth embodiment.
Figure 14:
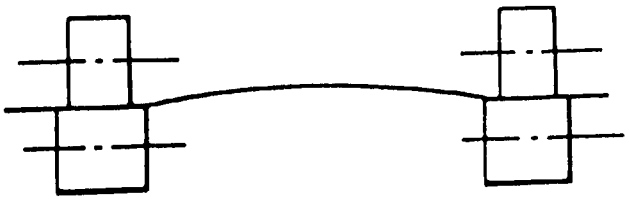
FIG. 14 is a front view showing a state where the center of a paper slip is bending.

The fifth embodiment according to the present invention will be now described with reference to FIGS. 11 through 13. Since the fifth embodiment differs from the above embodiments in that a thrusting plate (paper thrusting member) 95 is provided on a movable guide plate (movable guide member) 90 and operation for releasing a paper is not performed, it is mainly explained with regard to these differences. FIG. 12 is a plan view of a movable guide plate 90 and a thrusting plate 95, and FIG. 13 is a twice-enlarged view showing a cross-section taken along line XIII—XIII in FIG. 12. An upstream end of the movable guide plate 90 is supported by the shaft 23*a* and is inclined by the rotation of the shaft 23*a*. A rectangular recessed portion 91 is formed on an upper surface of the movable guide plate 90 and the thrusting plate 95 is fixed into this recessed portion 91 to locate it. Reference numeral 92 in the figures refers to a through hole which penetrates in the vertical direction, and the through hole 92 penetrates a below-described receiving plate (paper receiving member) 96 of the thrusting plate 95. Reference numeral 99 in FIG. 11 refers to a sensor for detecting the paper.

The thrusting plate 95 consists of a flexible synthetic resin plate. A downstream end of the thrusting plate 95 protrudes from the movable guide plate 90 toward the downstream, and two thrusting pieces 97 are formed at these two portions so as to protrude upward at an inclination of 45 degrees. The thrusting pieces 97 are disposed near the outside surface of an upper first discharge roller 40*b*. Two receiving plates (paper receiving member) 96 are formed on the thrusting plate 95 so as to penetrate the through hole 92 of the movable guide plate 90 and extend downward. The receiving plates 96 are disposed at both sides of the paper in the cross direction.

Thereafter, operation of the fifth embodiment will now be described with reference to FIG. 11, etc.

A. Paper Discharge

Since operations of printing through discharging the paper P are the same as in the above first embodiment, only operations and effects in the case in which the paper P is clamped into the pair of first discharge rollers 40 will now described. When a leading end of the paper P reaches the thrusting pieces 97 of the thrusting plate 95 in a state shown in FIG. 11, a free end of the thrusting plate 95 is flexibility bent downward by conveying force of the paper P, whereby the paper P is thrust on the upper first discharge roller 40*b* by elastic force of the thrusting plate 95. In the state in which the thrusting plate 95 bends downward, the thrusting pieces 97 turn to a clamping portion of the pair of first discharge rollers 40 so as to be located in the immediate vicinity of the clamping portion, whereby the leading end of the paper P discharged from the thrusting pieces 97 is directly inserted into the clamping portion and is clamped therebetween. Therefore, the paper can be securely clamped between the pair of first discharge rollers 40 even if the leading end of the paper P curls strongly downward.

B. Paper Collecting

Paper collection in the fifth embodiment is performed in the same way as in the above first embodiment; however, it is different in that the paper is not released by being pushed off. That is, the pair of first discharge rollers 40 and the pair of second discharge rollers 50 are rotated in reverse, whereby the paper P is backed through under the movable guide plate 90. In that case, even if a trailing end of the paper P curls strongly upward, the paper P cannot be inserted into the paper conveyor passage by the blocking of the thrusting pieces 97 of the thrusting plate 95. In the case in which the center of the paper P in the cross direction bends upward, the paper P has rigidity and linearly extends along the common tangent of the pair of first discharge rollers 40. When the trailing end of the paper P reaches the receiving plate 96, as shown in FIG. 13, the receiving plate 96 bends backward by paper conveying force. Bending force F guiding the paper downward is produced at the trailing end of the paper P. Consequently, bending of the paper P is eliminated, whereby the paper P can be collected without exerting an excessive load on the pair of first discharge rollers 40.

6. Modifications

The present invention can be modified as follows.

① A sensor for detecting a paper may be provided upstream of the pair of first discharge rollers 40, whereby rotation of the motor 42 can be started after the sensor detects the paper.

② Rotation of the motor 42 may be started after a given period elapses after printing on the first line starts.

③ The movable guide plate 23 may be inclined a plural number of times during paper collecting operation.

④ In the above embodiments, since an end of the movable guide plate 23 does not reach the driven roller 40*a* of the pair of first discharge rollers 40, a paper collecting passage for the paper P is always open. However, it may be constructed so that the movable guide plate 23 extends in the vicinity of the driven roller 40*a* so as to incline downward before the paper P collecting operation, whereby the paper collecting passage is temporarily opened.

⑤ The movable guide plate 23 is inclinably supported at a trailing end portion thereof; however, it may be inclinably supported at the side potion thereof, and other suitable constructions may be employed.

⑥ Only one receiving plate may be provided at the center of a paper in the cross direction. In this case, the plate having a greater width than that of the paper may be employed.

⑦ A ground wire is connected to the frame 21 and an electrical discharging brush is provided on an end of a receiving plate, and these may be set so that the electrical discharging brush comes in contact with a frame when a bending force is exerted on the receiving plate by conveying the force of the paper during paper collection. The paper can thereby be prevented from adhering to the receiving plate, the frame, or the like due to static electrical charge during the paper collection, so that the paper collection can be more smoothly performed.

As explained above, according to the present invention, paper jams and paper retention can be certainly prevented from occurring even if a paper wrinkles, curls strongly, or weakens, so that an issuance and collection of the paper can be reliably performed. Furthermore, it can yield effects so that problems can be prevented from occurring even if users perform various incorrect operations, or the like.

INDUSTRIAL APPLICABILITY

A paper discharge apparatus according to the present invention can be applied to an issuing apparatus for issuing a slip or a ticket from a dispenser, an ATM, etc. Since issuance and collection of the paper can be reliably performed even if a paper weakens, wrinkles, or curls strongly by absorbing moisture, in particular, it is suitable for an issuing apparatus in a device installed in an unmanned shop.

What is claimed is:

1. A paper discharge apparatus comprising:

a paper printing device for printing on a paper;

a paper conveyor device for conveying the paper to the paper printing device;

a paper cutting device disposed downstream of the paper printing device for cutting the paper when a printing operation is completed;

a pair of discharge rollers disposed downstream of the paper cutting device for conveying the paper toward a paper discharge port, the pair of discharge rollers clamping a leading end of the paper until the printing operation is completed so as to bend the paper downward to form a loop between the paper cutting device and the pair of discharge rollers, conveying the paper downstream until a trailing end of the paper leaves off the paper cutting device, and conveying the paper upstream to collect the paper which is discharged at the paper discharge port and not removed; and a paper sensing device provided near the paper discharge port;

wherein a paper guide device is provided along both surfaces of the paper between the paper cutting device and the pair of discharge rollers, having a movable guide member which is adapted to open the bottom of a paper conveyor passage extending from the paper cutting device to the pair of discharge rollers at least when the paper is bent downward to form a loop.

2. A paper discharge apparatus as recited in claim 1, wherein the movable guide member is inclinably supported at an upstream end thereof so as to move between a first position in which the guide member extends along the paper and a second position in which the guide member inclines downward, and a downstream free end of the guide member is inclined so as to release the paper to be collected.

3. A paper discharge apparatus as recited in claim 1, wherein the movable guide member is inclinably supported at an upstream end thereof so as to move between a first position in which the guide member extends along the paper and a second position in which the guide member inclines downward, and a paper thrusting member is protrudingly provided at a downstream free end of the movable guide member so as to reach the vicinity of an upper roller of the pair of discharge rollers when the movable guide member is located at the first position, and is flexibly bent downward to pass the paper to be discharged.

4. A paper discharge apparatus as recited in claim 3, wherein the movable guide member further comprises a paper receiving member extending downward from the upstream end thereof when the movable guide member is located at the first position, and the paper receiving member is flexibly bent by contacting the trailing end of the paper to be collected, thereby pushing the paper downward.

5. A paper discharge apparatus as recited in one of claims 2 to 4, wherein the movable guide member further comprises a shutter for opening and closing the discharge port in association with the inclination of the movable guide member.

6. A paper discharge apparatus comprising:

a paper printing device for printing on a paper;

a paper conveyor device for conveying the paper to the paper printing device;

a pair of first discharge rollers disposed downstream of the paper printing device for conveying the paper toward a paper discharge port;

a paper sensing device disposed downstream of the pair of discharge rollers; and a paper cutting device for cutting the paper when a printing operation is completed;

the pair of first discharge rollers clamping a leading end of the paper until the printing operation is completed so as to bend the paper downward to form a loop between the pair of first discharge rollers and the paper cutting device, conveying the paper downstream until a trailing end of the paper leaves off the paper cutting device, and conveying the paper upstream to collect the paper which is discharged at the paper discharge port and not removed; wherein a paper guide device is disposed downstream of the pair of first discharge rollers for guiding the paper toward the paper discharge port; and a pair of second discharge rollers is disposed downstream of the paper sensing device and at a position in the vicinity of the paper discharge port for clamping a trailing end of the paper by only itself until the paper is removed form the discharge port, and conveying the paper upstream of the pair of first discharge rollers for collection when the paper remains at the discharge port for a given period.

7. A paper discharge apparatus as recited in claim 6, wherein, when a given period elapses after the paper is discharged at the discharge port, the pair of second discharge rollers is rotated to convey the paper upstream to a position at which the paper sensing device can detect the paper, and the paper is collected when it is detected by the paper sensing device.

8. A paper discharge apparatus as recited in claim 7 wherein, after the paper is discharged at the discharge port, the pair of second discharge rollers is rotated to convey the paper upstream to a position at which the paper sensing device can detect the paper, and the paper is collected when the paper is continuously detected for a given period by the paper sensing device.

9. A paper discharge apparatus comprising:

a paper printing device for printing on a paper;

a paper conveyor device for conveying the paper to the paper printing device;

a pair of first discharge rollers disposed downstream of the paper printing device for conveying the paper toward a paper discharge port, a paper sensing device provided near the paper discharge port;

a paper cutting device disposed upstream of the pair of first discharge rollers for cutting the paper when a printing operation is completed; and a loop forming space disposed between the paper cutting device and the pair of first discharge rollers;

the pair of first discharge rollers clamping a leading end of the paper until the printing operation is completed so as to bend the paper downward to form a loop in the loop forming space, conveying the paper downstream until a trailing end of the paper leaves off the paper cutting device, and conveying the paper upstream to collect the paper which is discharged at the paper discharge port and not removed;

wherein a pair of second discharge rollers is disposed downstream of the pair of first discharge rollers and between the loop forming space and the paper discharge port, and a common tangent of the pair of second discharge rollers is inclined to that of the pair of first discharge rollers.

* * * * *